US009349266B2

(12) United States Patent
Stoddard

(10) Patent No.: US 9,349,266 B2
(45) Date of Patent: May 24, 2016

(54) SECURITY CABLE FOR A MOBILE PLATFORM WITH ELECTRONICALLY CONTROLLED LOCK

(71) Applicant: Intel Corporation, Santa Clara, CA (US)

(72) Inventor: Robert J. Stoddard, Folsom, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/362,442

(22) PCT Filed: Dec. 3, 2013

(86) PCT No.: PCT/US2013/072821

§ 371 (c)(1),
(2) Date: Jun. 3, 2014

(87) PCT Pub. No.: WO2015/084328

PCT Pub. Date: Jun. 11, 2015

(65) Prior Publication Data

US 2015/0154839 A1 Jun. 4, 2015

(51) Int. Cl.
*G08B 13/12* (2006.01)
*G08B 13/14* (2006.01)

(52) U.S. Cl.
CPC ..... *G08B 13/1445* (2013.01)

(58) Field of Classification Search
CPC ..... G06F 1/00; G08B 13/1445
USPC ..... 340/568.2, 568.4, 571, 568.1; 70/6, 58; 713/300
See application file for complete search history.

(56) References Cited

U.S. PATENT DOCUMENTS

| | | | | |
|---|---|---|---|---|
| 2001/0013010 | A1 | 8/2001 | Ward, II et al. | |
| 2003/0102957 | A1 | 6/2003 | Crisp | |
| 2004/0074264 | A1 | 4/2004 | Kung et al. | |
| 2005/0039502 | A1 | 2/2005 | Avganim | |
| 2006/0107073 | A1 * | 5/2006 | Lane et al. | 713/194 |
| 2007/0144225 | A1 * | 6/2007 | Tamura | 70/58 |
| 2013/0271260 | A1 | 10/2013 | Tubb et al. | |

OTHER PUBLICATIONS

International Search Report and Written Opinion received for PCT Patent Application No. PCT/US2013/072821, mailed on Aug. 27, 2014, 11 pages.

* cited by examiner

*Primary Examiner* — Toan N Pham
(74) *Attorney, Agent, or Firm* — Grossman, Tucker, Perreault & Pfleger, PLLC

(57) ABSTRACT

Generally, this disclosure provides devices, systems and methods for securing a mobile platform with a security cable, employing an electronically controlled locking mechanism which may be in communication with the platform. A device may include a lock to mate with a lock receiver of the platform, and the lock is coupled to the cable; a locking mechanism driver module to controllably engage and release the lock from the lock receiver; and a communication interface module to receive a signal from the platform and to control the locking mechanism driver module based on the signal.

25 Claims, 5 Drawing Sheets

SECURITY CABLE FOR A MOBILE PLATFORM WITH ELECTRONICALLY CONTROLLED LOCK

FIELD

The present disclosure relates to security cables, and more particularly, to security cables for mobile platforms with electronically controlled locking mechanisms.

BACKGROUND

Mobile platforms, for example laptops, notebooks and tablets, etc., offer increased capability and convenience to their users by virtue of their mobility, but also present an increased risk of theft for this same reason. There are no relatively convenient and inexpensive ways for a user to physically secure their mobile platform when away from their primary workspace, such as, for example in a conference room, coffee shop, airline terminal, etc. Current solutions include dedicated docking stations and key/combination lock cables but these methods are cumbersome, combinations may be forgotten and keys may be lost, stolen or duplicated. Additionally, it is often impractical to pack up and/or lock a laptop every time the user needs to be away for a few minutes.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts, and in which:

Although the following Detailed Description will proceed with reference being made to illustrative embodiments, many alternatives, modifications, and variations thereof will be apparent to those skilled in the art.

DETAILED DESCRIPTION

Generally, this disclosure provides devices, systems and methods for securing a mobile platform with a security cable, employing an electronically controlled locking mechanism which may be in communication with the platform. The security cable may be a looping cable configured to loop around or otherwise securely attach, at one end of the cable, to a physical structure such as a relatively immobile item of furniture, or other suitable object. The cable may further include a lock control module, for example at the other end of the cable and in relative proximity to the platform. The lock control module may be configured to electronically engage or release a lock that mates with a lock receiver on the mobile platform. The lock control module may control the lock based on a signal received from the platform, for example through a Universal Serial Bus (USB) interface or a wireless interface. The platform may generate this locking signal based on user input received through any suitable user interface such as, for example, a logout command, a lock screen command or the toggling of a lock/release icon.

Figure 1:
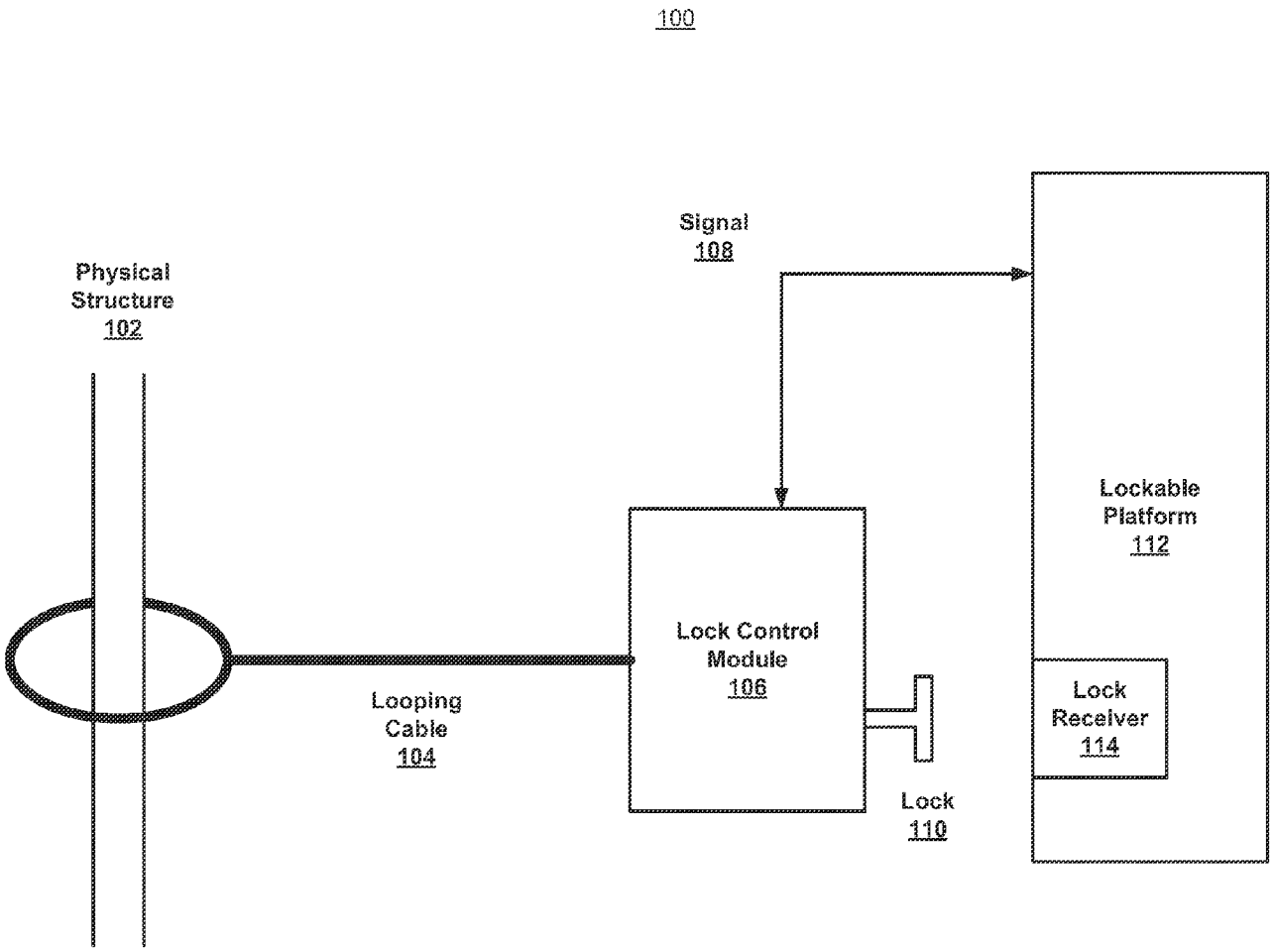
FIG. 1 illustrates a top level system diagram of one example embodiment consistent with the present disclosure.

FIG. 1 illustrates a top level system diagram 100 of one example embodiment consistent with the present disclosure. A security cable 104 is shown to have a looping end that may be secured to a physical structure 102. The looping end may be referred to as the "far" end of the cable, herein, for convenience. Although a loop is shown for illustrative purposes, any suitable arrangement or configuration of the far end of the cable 104 may be used to provide a suitably secure attachment point to the relatively immobile physical structure 102. The opposite end, or "near" end, of cable 104 may be coupled to a lock control module 106, the operation of which will be discussed in greater detail below, which may be configured to engage and release lock 110 from lock receiver 114 of lockable platform 112. Lock control module 106 may communicate with platform 112, for example through signal 108, with regard to the past, current or desired future state of lock 110.

It will be appreciated that the various components, including the cable 104, the lock control module 106 and the lock 110, may be designed and manufactured to a physical strength sufficient to provide tamper resistance and theft deterrence.

Figure 2:
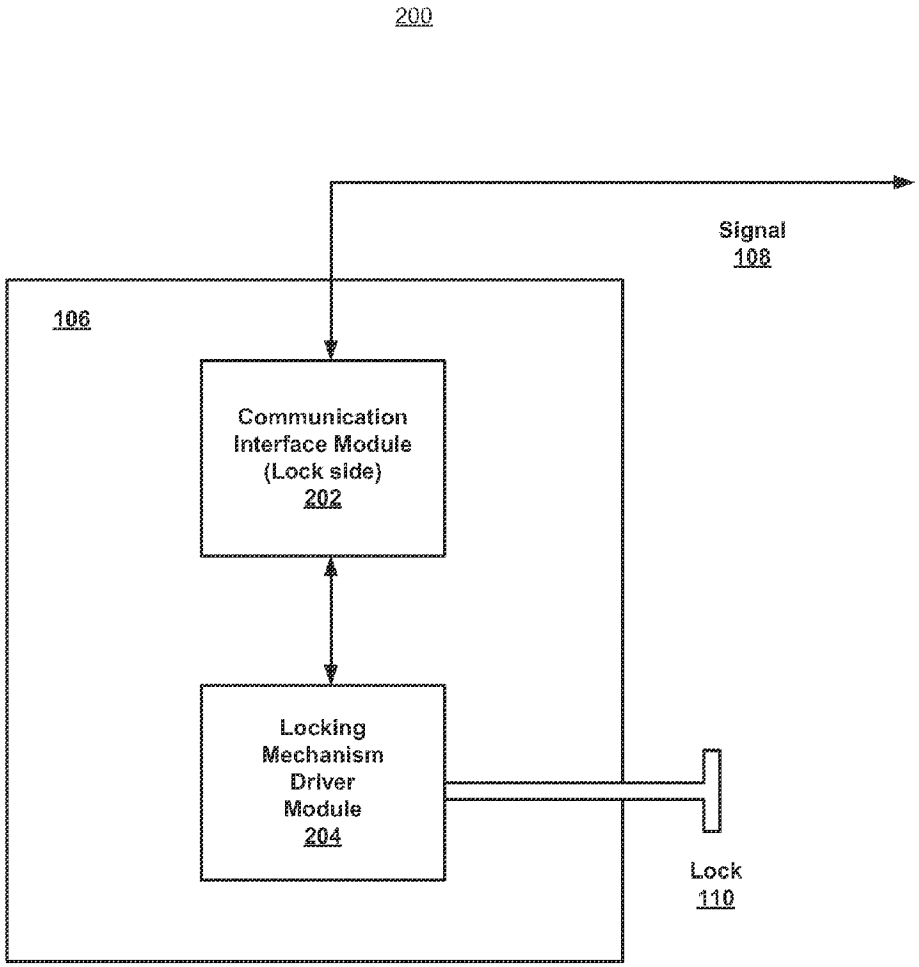
FIG. 2 illustrates a block diagram of one example embodiment consistent with the present disclosure.

FIG. 2 illustrates a block diagram 200 of one example embodiment consistent with the present disclosure. Lock control module 106 is shown to include communication interface module 202 and locking mechanism driver module 204. The communication interface module 202 may be configured to receive a signal 108 from the platform 112 and to control the locking mechanism driver module 204 based, at least in part, on that signal. The signal 108 may include a request to either engage or release the lock 110 from the platform's lock receiver 114. In some embodiments, the communication interface module 202 may be configured to implement a USB or micro-USB interface between the lock control module 106 and the platform 112. In some embodiments, the communication interface module 202 may be configured to implement wireless interface between the lock control module 106 and the platform 112, such as, for example, a Wireless-Fidelity (Wi-Fi) interface, a Bluetooth interface or any other suitable wireless communications protocol.

Locking mechanism driver module 204 may be configured to engage, release or otherwise manipulate the lock 110, under the control of communication interface module 202 so as to either secure or free the platform 112 from the cable 104. Any suitable type of physical locking mechanism may be employed. In some embodiments, for example, the lock 110 may physically rotate, latch or tighten into lock receiver 114. Locking mechanism driver module 204 may therefore include any type of actuator, motor, solenoid or other type of electrical and/or mechanical mechanism to induce a physical motion or change in orientation of lock 110.

Figure 3:
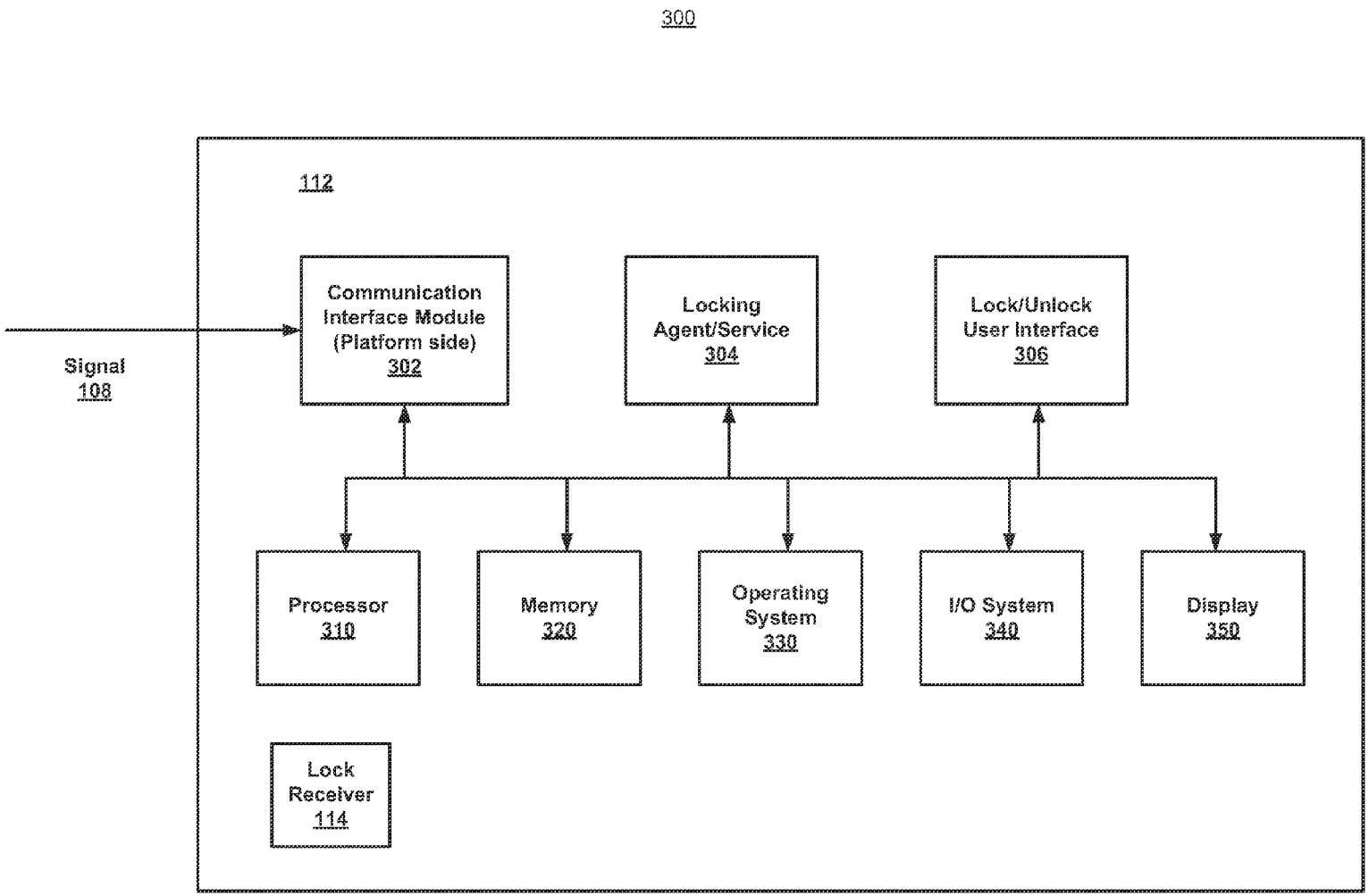
FIG. 3 illustrates a platform of one example embodiment consistent with the present disclosure.

FIG. 3 illustrates a block diagram 300 of a platform consistent with one example embodiment of the present disclosure. Platform 112 is shown to include a communication interface module 302, a locking agent or service module 304 and a lock/unlock user interface 306, the operations of which will be described in greater detail below. Platform 112 may also include a lock receiver 114 configured to accept/engage or mate with lock 110 of lock control module 106. Platform 112 may also include a processor 310, memory 320, operating system (OS) 330, input/output system 340 and display 350, which in some embodiments may be a touchscreen display.

Lock/unlock user interface 306 may be configured to provide the user of the platform with a lock/release icon or other suitable interface through which the user may view the current lock status and/or provide a lock status modification request (e.g., a change from lock to unlock or vice versa). The icon may be displayed on display 350 and user input may be received through a touchscreen, keyboard, mouse or other suitable I/O device, for example through I/O system 340. Locking agent or service module 304 may be configured to determine the current or desired lock status (e.g., locked, unlocked, etc.) of the platform based on the user input which may be provided by the Lock/Unlock user interface 306. In some embodiments, the user lock status modification request may be provided by the OS 330 (and detected by the locking agent or service module 304) as a lock request in response to a conventional logout or lockscreen command issued by the user. This may be accomplished, for example under the Windows OS, by clicking on a menu item associated with the "start" button or by simultaneously pressing the control-alt-del keys. Similarly, the OS 330 may provide an unlock request in response to the user logging in to the platform.

The platform side communication interface module 302 may be configured receive the lock status modification request from the locking agent or service module 304 and to transmit a signal 108 from the platform 112 to the lock control module 106. The signal may include a request for the lock control module 106 to either engage or release the lock 110 from the platform's lock receiver 114. In some embodiments, the communication interface module 302 may be configured to implement a USB or micro-USB interface between the lock control module 106 and the platform 112. In some embodiments, the communication interface module 302 may be configured to implement wireless interface between the lock control module 106 and the platform 112, such as, for example, a Wireless-Fidelity (Wi-Fi) interface, a Bluetooth interface or any other suitable wireless communications protocol.

In some embodiments, the locking agent or service module 304 may be provided as open source software or as proprietary software and may be configured to interact (e.g., be compatible with) the platform OS 330.

Examples of platform 112 may include, but are not limited to, a mobile communication device such as a cellular handset or a smartphone based on the Android® OS, iOS®, Windows® OS, Blackberry® OS, Palm® OS, Symbian® OS, etc., a mobile computing device such as a tablet computer like an iPad®, Surface®, Galaxy Tab®, Kindle Fire®, etc., an Ultrabook® including a low-power chipset manufactured by Intel Corporation, a netbook, a notebook, a laptop or a palmtop.

In platform 112, processor 310 may comprise one or more processors situated in separate components, or alternatively, one or more processing cores embodied in a single component (e.g., in a System-on-a-Chip (SoC) configuration) and any processor-related support circuitry (e.g., bridging interfaces, etc.). Example processors may include, but are not limited to, various x86-based microprocessors available from the Intel Corporation including those in the Pentium, Xeon, Itanium, Celeron, Atom, Core i-series product families, Advanced RISC (e.g., Reduced Instruction Set Computing) Machine or "ARM" processors, etc. Examples of support circuitry may include chipsets (e.g., Northbridge, Southbridge, etc. available from the Intel Corporation) configured to provide an interface through which processor 310 may interact with other system components that may be operating at different speeds, on different buses, etc. in platform 112. Some or all of the functionality commonly associated with the support circuitry may also be included in the same physical package as the processor (e.g., such as in the Sandy Bridge family of processors available from the Intel Corporation).

Figure 4:
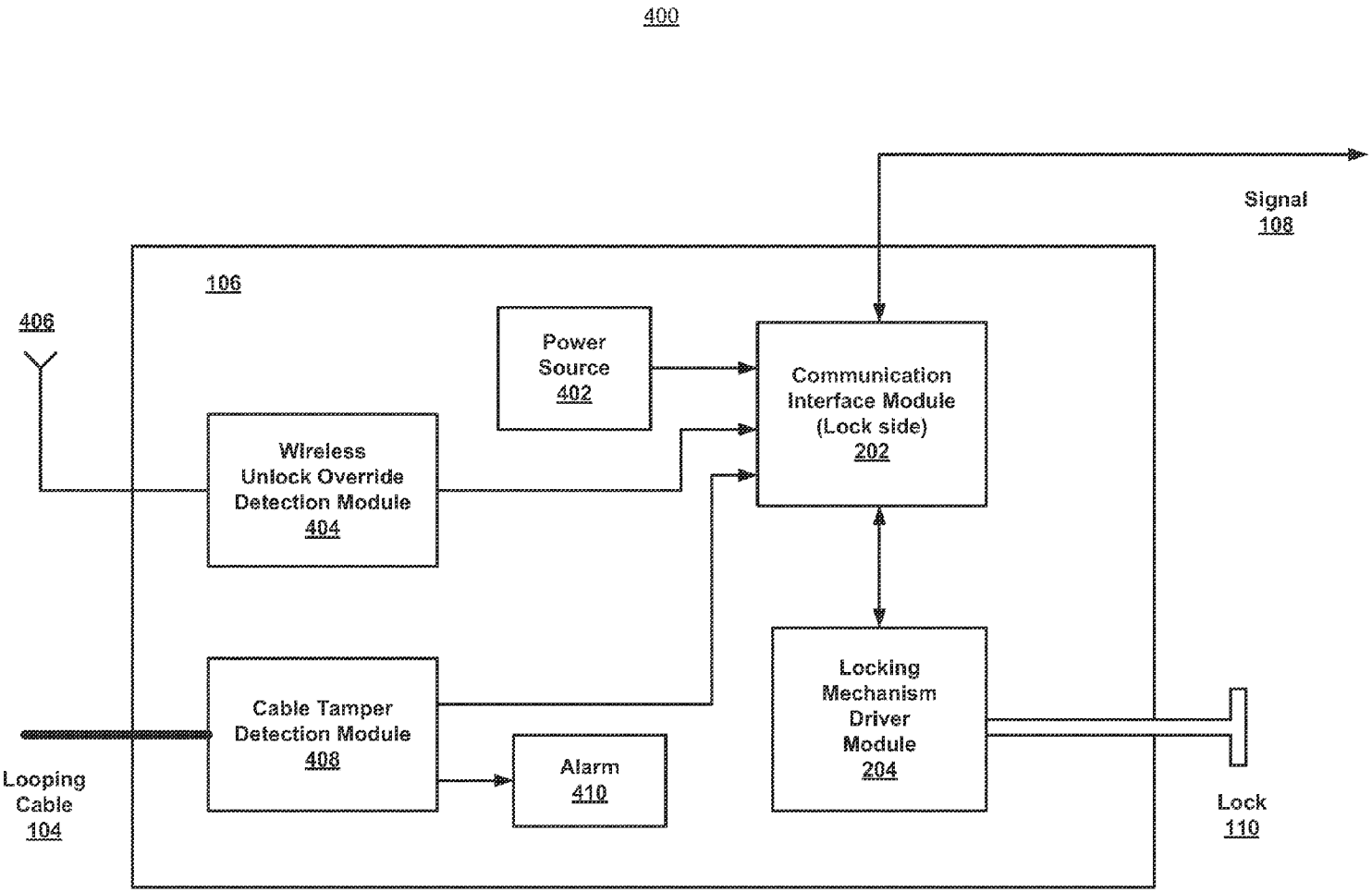
FIG. 4 illustrates a block diagram of another example embodiment consistent with the present disclosure.

FIG. 4 illustrates a block diagram 400 of another example embodiment consistent with the present disclosure. Lock control module 106 is shown to additionally include a power source 402, a wireless unlock override detection module 404 and associated antenna 406, a cable tamper detection module 408 and an alarm 410.

In some embodiments, for example where USB or micro-USB is used for communication between lock control module 106 and platform 112, power may optionally be provided to lock control module 106 by platform 112 through the USB or micro-USB port. In other embodiments, a power source or supply 402 may be included in lock control module 106. In some embodiments, the power source 402 may be a battery. In some embodiments, the power source 402 may be a voltage converter configured to transform a line voltage, for example provided through a power cord, to a voltage suitable for operation of the electronic circuitry associated with the lock control module 106.

Wireless unlock override detection module 404 may be configured to receive a wireless signal, for example through antenna 406, that may be employed to override the current lock status. It will be appreciated that such an override signal (or back door method) may be useful to unlock the platform in circumstances where, for example, the user has forgotten a password or inadvertently left the device behind and locked at some location. The override capability may be managed/controlled by an information technology (IT) department or a manager of the premises (for example a coffee shop or traveler's workstation). In some embodiments, override permission may be based on ownership of the security cable and may be pre-arranged. Alternatively, a second mobile device, for example a user wearable device with Bluetooth capability, may be configured and enabled to provide the unlock override signal.

Cable tamper detection module 408 may be configured to detect a break or cut in the cable 104 which may indicate that the platform has been stolen. In response to this condition, an audible alarm 410 may be set off and/or a wireless signal may be sent to the platform to disable it. In some embodiments, the alarm may be located, either additionally or alternatively, in the platform 112. Cable tamper detection may be based on an electrical impedance measurement of the cable or any other suitable cable continuity detection methods such as the detection of a reflection of a transmitted signal pulse down the length of the cable, which may be modified by a cut in the cable.

Figure 5:
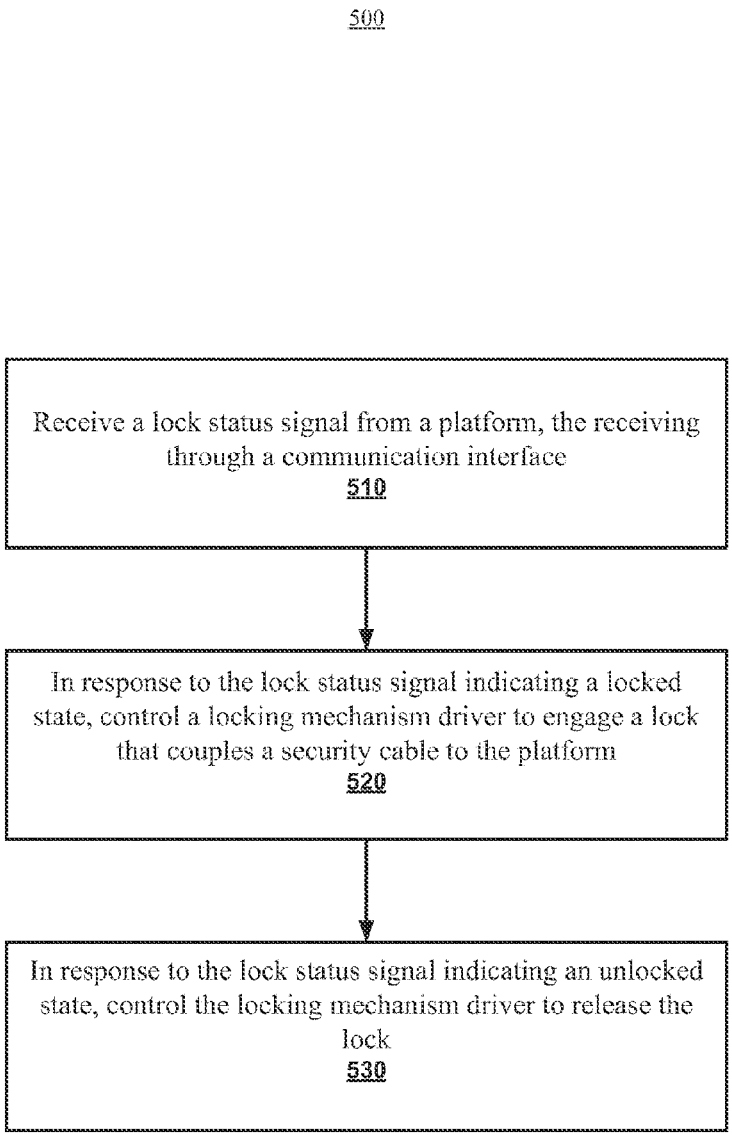
FIG. 5 illustrates a flowchart of operations of one example embodiment consistent with the present disclosure.

FIG. 5 illustrates a flowchart of operations 500 of another example embodiment consistent with the present disclosure. At operation 510, a lock status signal is received from a platform. The signal is received through a communication interface, which may be a USB, micro-USB, Wi-Fi or Bluetooth interface. At operation 520, a locking mechanism driver is controlled to engage a lock that couples a security cable to the platform in response to the lock status signal indicating a locked state. At operation 530, the locking mechanism driver is controlled to release the lock in response to the lock status signal indicating an unlocked state.

Embodiments of the methods described herein may be implemented in a system that includes one or more storage mediums having stored thereon, individually or in combination, instructions that when executed by one or more processors perform the methods. Here, the processor may include, for example, a system CPU (e.g., core processor) and/or programmable circuitry. Thus, it is intended that operations according to the methods described herein may be distributed across a plurality of physical devices, such as processing structures at several different physical locations. Also, it is intended that the method operations may be performed individually or in a subcombination, as would be understood by one skilled in the art. Thus, not all of the operations of each of the flow charts need to be performed, and the present disclosure expressly intends that all subcombinations of such operations are enabled as would be understood by one of ordinary skill in the art.

The storage medium may include any type of tangible medium, for example, any type of disk including floppy disks, optical disks, compact disk read-only memories (CD-ROMs), compact disk rewritables (CD-RWs), digital versatile disks (DVDs) and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions.

"Circuitry", as used in any embodiment herein, may comprise, for example, singly or in any combination, hardwired circuitry, programmable circuitry, state machine circuitry, and/or firmware that stores instructions executed by programmable circuitry. An "application" (app), "agent" or "service" may be embodied as code or instructions which may be executed on programmable circuitry such as a host processor or other programmable circuitry and may, in some embodiments, work in conjunction with or as a component of an Operating System. A module, as used in any embodiment herein, may be embodied as circuitry. The circuitry may be embodied as an integrated circuit, such as an integrated circuit chip.

Thus, the present disclosure provides devices, methods, systems and computer-readable storage medium for securing a mobile platform with a security cable, employing an electronically controlled locking mechanism which may be in communication with the platform. The following examples pertain to further embodiments.

The device may include a lock to mate with a lock receiver of the platform, the lock coupled to the cable. The device of this example may also include a locking mechanism driver module to controllably engage and release the lock from the lock receiver. The device of this example may further include a communication interface module to receive a signal from the platform and to control the locking mechanism driver module based on the signal.

Another example device includes the forgoing components and the communication interface module is a Universal Serial Bus (USB) interface.

Another example device includes the forgoing components and the communication interface module is a micro-USB interface, a Wireless-Fidelity (Wi-Fi) interface or a Bluetooth interface.

Another example device includes the forgoing components and further includes an unlock override module to detect a wireless unlock override signal and to cause the locking mechanism driver module to release the lock in response to the detection.

Another example device includes the forgoing components and further includes a cable tamper detection module to detect a break in the cable and an alarm module to generate an alarm in response to the detected break.

Another example device includes the forgoing components and the device receives electrical power for operation from the platform through the communication interface module.

Another example device includes the forgoing components and further includes a battery to provide electrical power for operation.

Another example device includes the forgoing components and the cable is a looping cable to secure to a physical structure.

According to another aspect there is provided a platform. The platform may include a user interface to accept a lock status modification request from a user of the platform. The platform of this example may also include a locking agent module to determine a lock status of the platform based on the request. The platform of this example may further include a communication interface module to transmit the lock status to a lock control module coupled to a security cable. The platform of this example may further include a lock receiver to mate with a locking mechanism of the lock control module.

Another example platform includes the forgoing components and the communication interface module is a USB interface.

Another example platform includes the forgoing components and the communication interface module is a micro-USB interface, a Wi-Fi interface or a Bluetooth interface.

Another example platform includes the forgoing components and the lock status modification request is a logout command or a lock screen command.

Another example platform includes the forgoing components and the platform is a laptop, a tablet, a notebook or an Ultrabook.

Another example platform includes the forgoing components and the user interface further includes a touch screen display.

Another example platform includes the forgoing components and the locking agent module provides a lock/release icon associated with the user interface, the icon to indicate the lock status and to accept the lock status modification request.

According to another aspect there is provided a method. The method may include receiving a lock status signal from a platform, the receiving through a communication interface. The method of this example may also include, in response to the lock status signal indicating a locked state, controlling a locking mechanism driver to engage a lock, the lock coupling a security cable to the platform. The method of this example may further include, in response to the lock status signal indicating an unlocked state, controlling the locking mechanism driver to release the lock.

Another example method includes the forgoing operations and the communication interface is a USB interface.

Another example method includes the forgoing operations and the communication interface is a micro-USB interface, a Wi-Fi interface or a Bluetooth interface.

Another example method includes the forgoing operations and further includes wirelessly receiving an unlock override signal and controlling the locking mechanism driver to release the lock in response to the reception.

Another example method includes the forgoing operations and further includes detecting a break in the security cable and generating an alarm in response to the detected break.

According to another aspect there is provided a system. The system may include a means for receiving a lock status signal from a platform, the receiving through a communication interface. The system of this example may also include, a means for, in response to the lock status signal indicating a locked state, controlling a locking mechanism driver to engage a lock, the lock coupling a security cable to the platform. The system of this example may further include, a means for, in response to the lock status signal indicating an unlocked state, controlling the locking mechanism driver to release the lock.

Another example system includes the forgoing operations and the communication interface is a USB interface.

Another example system includes the forgoing operations and the communication interface is a micro-USB interface, a Wi-Fi interface or a Bluetooth interface.

Another example system includes the forgoing operations and further includes means for wirelessly receiving an unlock override signal and controlling the locking mechanism driver to release the lock in response to the reception.

Another example system includes the forgoing operations and further includes means for detecting a break in the security cable and generating an alarm in response to the detected break.

According to another aspect there is provided a method. The method may include accepting a lock status modification request from a user of the platform. The method of this example may also include determining a lock status of the platform based on the request. The method of this example may further include transmitting the lock status to a lock control module, the lock control module to couple the platform to a security cable.

Another example method includes the forgoing operations and the transmitting is through a USB interface.

Another example method includes the forgoing operations and the transmitting is through a micro-USB interface, a Wi-Fi interface or a Bluetooth interface.

Another example method includes the forgoing operations and the lock status modification request is a logout command or a lock screen command.

Another example method includes the forgoing operations and further includes providing a lock/release icon through a user interface, the icon to indicate the lock status and to accept the lock status modification request.

According to another aspect there is provided a system. The system may include a means for accepting a lock status modification request from a user of the platform. The system of this example may also include a means for determining a lock status of the platform based on the request. The system of this example may further include a means for transmitting the lock status to a lock control module, the lock control module to couple the platform to a security cable.

Another example system includes the forgoing operations and the transmitting is through a USB interface.

Another example system includes the forgoing operations and the transmitting is through a micro-USB interface, a Wi-Fi interface or a Bluetooth interface.

Another example system includes the forgoing operations and the lock status modification request is a logout command or a lock screen command.

Another example system includes the forgoing operations and further includes means for providing a lock/release icon through a user interface, the icon to indicate the lock status and to accept the lock status modification request.

According to another aspect there is provided at least one computer-readable storage medium having instructions stored thereon which when executed by a processor, cause the processor to perform the operations of the method as described in any of the examples above.

According to another aspect there is provided an apparatus including means to perform a method as described in any of the examples above.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

What is claimed is:

1. A device for securing a cable to a platform, said device comprising:

a lock to mate with a lock receiver of said platform, said lock coupled to said cable;

a locking mechanism driver module to controllably engage and release said lock from said lock receiver; and a communication interface module to receive a control signal from said platform and, in response to the control signal, to cause said locking mechanism driver module to engage or release said lock from said lock receiver.

2. The device of claim 1, wherein said communication interface module is a Universal Serial Bus (USB) interface.

3. The device of claim 1, wherein said communication interface module is a micro-USB interface, a Wireless-Fidelity (Wi-Fi) interface or a Bluetooth interface.

4. The device of claim 1, further comprising an unlock override module that is configured to monitor for detection of a wireless unlock override signal and, in response to detection of the wireless unlock override signal, to cause said locking mechanism driver module to release said lock even in an absence of said control signal.

5. The device of claim 1, further comprising a cable tamper detection module to detect a break in said cable and an alarm module to generate an alarm in response to said detected break.

6. The device of claim 1, wherein said device is configured to receive electrical power for operation from said platform through said communication interface module.

7. The device of claim 1, further comprising a battery to provide electrical power for operation.

8. The device of claim 1, wherein said cable is a looping cable to secure to a physical structure.

9. A computer-readable storage medium having instructions stored thereon which when executed by a processor result in the following operations for securing a cable to a platform, said operations comprising:

receiving, via a communication interface of a platform, a lock status signal indicating a lock status of said platform; and issuing a control signal in response to said lock status signal;

wherein:

when said lock status signal indicates that said platform is in a locked state, said control signal is configured to cause a lock of a security cable to be driven to a locked state; and when said lock status signal indicates that said platform is in unlocked state, said control signals is configured to cause the lock of the security cable to be driven to an unlocked state.

10. The computer-readable storage medium of claim 9, wherein said communication interface is a USB interface.

11. The computer-readable storage medium of claim 9, wherein said communication interface is a micro-USB interface, a Wi-Fi interface or a Bluetooth interface.

12. The computer-readable storage medium of claim 9, wherein said instructions when executed further result in performance of the following operations comprising:

monitoring for a reception of a wireless unlock override signal; and in response to reception of the wireless unlock override signal, causing the lock of the security cable to be driven to the unlocked state, even in an absence of said control signal.

13. The computer-readable storage medium of claim 9, wherein said instructions when executed further result in performance of the following operations comprising:

monitoring for a break in said security cable; and generating an alarm in response to detection of a break in said security cable, further comprising the operations of detecting a break in said security cable and generating an alarm in response to said detected break.

14. A platform comprising:

a user interface to accept a lock status modification request from a user of said platform, the lock status modification request configured to drive said platform to a locked or unlocked state;

a locking agent module to determine a lock status of said platform in response to detection of the lock status modification request;

a communication interface module to transmit said lock status to a lock control module coupled to a security cable; and a lock receiver to mate with a locking mechanism of said lock control module;

wherein:

when said lock status indicates that said platform is in a locked state, said lock control module is to drive said locking mechanism to a locked state; and when said lock status indicates that said platform is in an unlocked state, said lock control module is to drive said locking mechanism to an unlocked state.

15. The platform of claim 14, wherein said communication interface module is a USB interface.

16. The platform of claim 14, wherein said communication interface module is a micro-USB interface, a Wi-Fi interface or a Bluetooth interface.

17. The platform of claim 14, wherein said user interface comprises an operating system of said platform and said lock status modification is a logout or lock screen command of said operating system.

18. The platform of claim 14, wherein said platform is a laptop, a tablet, a notebook or an Ultrabook.

19. The platform of claim 14, wherein said user interface further comprises a touch screen display.

20. The platform of claim 14, wherein said locking agent module provides a lock/release icon associated with said user interface, said icon to indicate said lock status and to accept said lock status modification request.

21. A computer-readable storage medium having instructions stored thereon which when executed by a processor result in the following operations for securing a platform to a cable, said operations comprising:

accepting a lock status modification request from a user of said platform via a user interface of said platform;

in response to the lock status modification request, driving said platform to a locked or an unlocked state;

determining a lock status of said platform in response to said lock status modification request; and transmitting said lock status to a lock control module, said lock control module comprising a locking mechanism to couple said platform to a security cable;

wherein:

when said lock status indicates that said platform is in a locked state, said lock control module is to drive said locking mechanism to a locked state; and when said lock status indicates that said platform is in an unlocked state, said lock control module is to drive said locking mechanism to an unlocked state.

22. The computer-readable storage medium of claim 21, wherein said transmitting is through a USB interface.

23. The computer-readable storage medium of claim 21, wherein said transmitting is through a micro-USB interface, a Wi-Fi interface or a Bluetooth interface.

24. The computer-readable storage medium of claim 21, wherein said user interface comprises an operating system of said platform and said lock status modification request is a logout or lock screen command of said operating system.

25. The computer-readable storage medium of claim 21, wherein said instructions when executed further result in the performance of the following operations comprising:

providing a lock/release icon through said user interface, said lock/release icon to indicate said lock status and to accept said lock status modification request.

* * * * *